US006203687B1

(12) United States Patent
Andolfatto

(10) Patent No.: US 6,203,687 B1
(45) Date of Patent: Mar. 20, 2001

(54) METHOD FOR SHUTTING DOWN AN ELECTROLYSIS CELL WITH A MEMBRANE AND AN OXYGEN-REDUCING CATHODE

(75) Inventor: Francoise Andolfatto, Lyons (FR)

(73) Assignee: Elf Atochem, S.A., Puteaux (FR)

( * ) Notice: Subject to any disclaimer, the term of this patent is extended or adjusted under 35 U.S.C. 154(b) by 0 days.

(21) Appl. No.: 09/208,586

(22) Filed: Dec. 10, 1998

(30) Foreign Application Priority Data

Dec. 10, 1997 (FR) ..... 97 15607

(51) Int. Cl.[7] ..... C25B 15/00

(52) U.S. Cl. ..... 205/515; 205/525; 205/526; 205/531

(58) Field of Search ..... 205/515, 525, 205/526, 531

(56) References Cited

U.S. PATENT DOCUMENTS 4,185,142 * 1/1980 Solomon et al. ..... 429/49

FOREIGN PATENT DOCUMENTS 6017279 6/1992 (JP) .

OTHER PUBLICATIONS

JP 6017279—English Abstracts Aug. 1994.

* cited by examiner

*Primary Examiner*—Arun S. Phasge
(74) *Attorney, Agent, or Firm*—Millen, White, Zelano & Branigan

(57) ABSTRACT

The invention relates to a method for shutting down an electrolysis cell with a membrane and an oxygen-reducing cathode, which comprises, after the electrical power and oxygen supplies have been disconnected, in emptying the oxygen compartment and filling it with demineralized water having a pH≦7 and in keeping this water in the oxygen compartment throughout the shutdown period.

11 Claims, 2 Drawing Sheets

METHOD FOR SHUTTING DOWN AN ELECTROLYSIS CELL WITH A MEMBRANE AND AN OXYGEN-REDUCING CATHODE

FIELD OF THE INVENTION

The present invention relates to a method for shutting down an electrolysis cell with a membrane and an oxygen-reducing cathode (or an oxygen diffusion cathode).

More precisely, the invention relates to a method for shutting down an electrolysis cell with a membrane and an oxygen-reducing cathode which produces an aqueous solution of sodium hydroxide and chlorine by electrolysis of an aqueous NaCl solution, the said cell having been turned off intentionally or following an operational incident, then turned on again.

BACKGROUND OF THE INVENTION

The electrolysis cells with a membrane and an oxygen-reducing cathode have resulted, on the one hand, from the remarkable improvements obtained recently in terms of fluorinated ion-exchange membranes, which have made it possible to develop methods for electrolysing sodium chloride solutions by means of ion-exchange membranes. This technique makes it possible to produce hydrogen and sodium hydroxide in the cathode compartment, and chlorine in the anode compartment, of a brine electrolysis cell.

Furthermore, in order to reduce energy consumption, it has been proposed to use an oxygen-reducing electrode as the cathode, and to introduce a gas containing oxygen into the cathode compartment in order to prevent hydrogen evolution and to significantly reduce the electrolysis cell voltage.

In theory, it is possible to reduce the electrolysis voltage by 1.23 V by using the cathode reaction with supply of oxygen represented by (1) instead of the cathode reaction without supply of oxygen represented by (2):

$$2H_2O+O_2+4e^- \rightarrow 4OH^- \quad (1)$$

E=+0.40 V (relative to a standard hydrogen electrode).

$$4H_2O+4e^- \rightarrow 2H_2+4OH^- \quad (2)$$

E=0.83 V (relative to a standard hydrogen electrode).

A conventional membrane electrolysis cell using the gas technology comprises a gas diffusion electrode (cathode) which is placed in the cathode compartment of the electrolysis cell and divides the said compartment into a solution compartment, on the ion-exchange membrane side, and a gas compartment on the opposite side.

An electrochemical cell of this type therefore generally consists of 3 separate compartments:

an anode compartment, a sodium hydroxide compartment, placed between a cation-exchange membrane (Nafion N966, Flémion F892) and the cathode, and a gas compartment.

The cathode is generally made of a silvered nickel grid covered on either side with platinized carbon.

One of the faces is coated with a fluorocarbon micropore layer in order to make it more hydrophobic.

Platinum represents 5% to 20% by weight of the carbon/platinum combination, and its average mass per unit surface area may range from 0.2 to 4 mg/cm$^2$.

Conventional electrolysis cells with a membrane and a cathode evolving hydrogen, that is to say those employing reaction (2) mentioned above, are sometimes turned off to perform a variety of maintenance operations, or else following an incident. In such cases as these, the electrodes are de-energized, that is to say they are no longer supplied with electrical power.

Industrially, these outage phases can be managed in the following way: turning off the power and continuing the flow and addition of fluids (water and brine). The following procedure may also be adopted: turning off the power, emptying the sodium hydroxide and brine compartments, then filling with 20% strength sodium hydroxide solution (i.e. about 4 M) in the case of the cathode compartment, and with 220 g/l of brine in the case of the anode compartment (eliminating the active chlorine).

This operation is intended to preserve the performance of the membrane.

When conditions of this type are applied during outage phases to electrolysis cells with a membrane and an oxygen-reducing cathode, a significant increase in the cathode potential is observed when the electrolysis is resumed. This cathode alteration affects the voltage of the cell and leads to a significant increase in the energy consumption, which may be up to 100 kWh/tonne of sodium hydroxide produced.

Without tying applicant to an explanation, it is reasonable to assume that, in view of the simultaneous presence of oxygen and sodium hydroxide, the carbon of the de-energized cathode reacts with the oxygen and sodium hydroxide to form sodium carbonate, which deposits on the cathode. It reduces its porosity and electrical conductivity.

In order to overcome these drawbacks, Patent Application EP 0064874 has proposed a procedure which consists in completely replacing the gas (containing oxygen) in the gas compartment with nitrogen, and in keeping the nitrogen in the said gas compartment throughout the outage period.

Under these conditions, it is observed that after very short outages (a few hours), the cathode potential is little altered on restarting.

SUMMARY OF THE INVENTION

A method has now been found for shutting down an electrolysis cell with a membrance and oxygen-reducing cathode, characterized in that, after the electrical power and oxygen supplies to the said cell have been disconnected, the gas compartment is emptied and filled with demineralized water having a pH equal to or less than 7, the cathode is rinsed with demineralized water from the gas compartment until a pH equal to or less than 7 is obtained, for example a pH equal to that of the demineralized water which was introduced, and the said gas compartment is kept filled with the said demineralized water throughout the shutdown period.

The use of demineralized water is superior than the use of nitrogen because it permits the elimination of carbonated ions.

According to the present invention, the demineralized water may be acidified by means of inorganic acids such as HCl, or $H_2SO_4$ so as to obtain a pH of between 0 and 7. Preferably, use will be made of demineralized aqueous solutions of the said inorganic acids, having concentrations in mol-g/l of between 0.1 and 1, thereby providing pH values well below 7, e.g. a pH between 0.1 and 1.

In the shutdown method according to the present invention, the anolyte and water supplies may be maintained, or alternatively the anode compartment may be emptied then filled with a clean anolyte of the same type and same concentration (this operation making it possible to eliminate the active chlorine) and the sodium hydroxide compartment may be emptied then filled with a sodium hydroxide solution of low molar concentration (molarity), generally between 0.5 and 5 mol-g/l, and preferably close to 1 mol-g/l.

The temperature of the liquids which are introduced into the various compartment of the electrolysis cell which has been shut down is between 20° C. and 80° C., and preferably between 30° C. and 60° C.

These temperatures are maintained throughout the period during which the cell is shut down.

This shutdown method applies more particularly to shutting down cells with a membrane and an oxygen-reducing cathode which have 3 compartments.

BRIEF DESCRIPTION OF THE DRAWING

An electrolysis cell of this type is schematically represented in FIG. 1.

It comprises:

Figure 1:
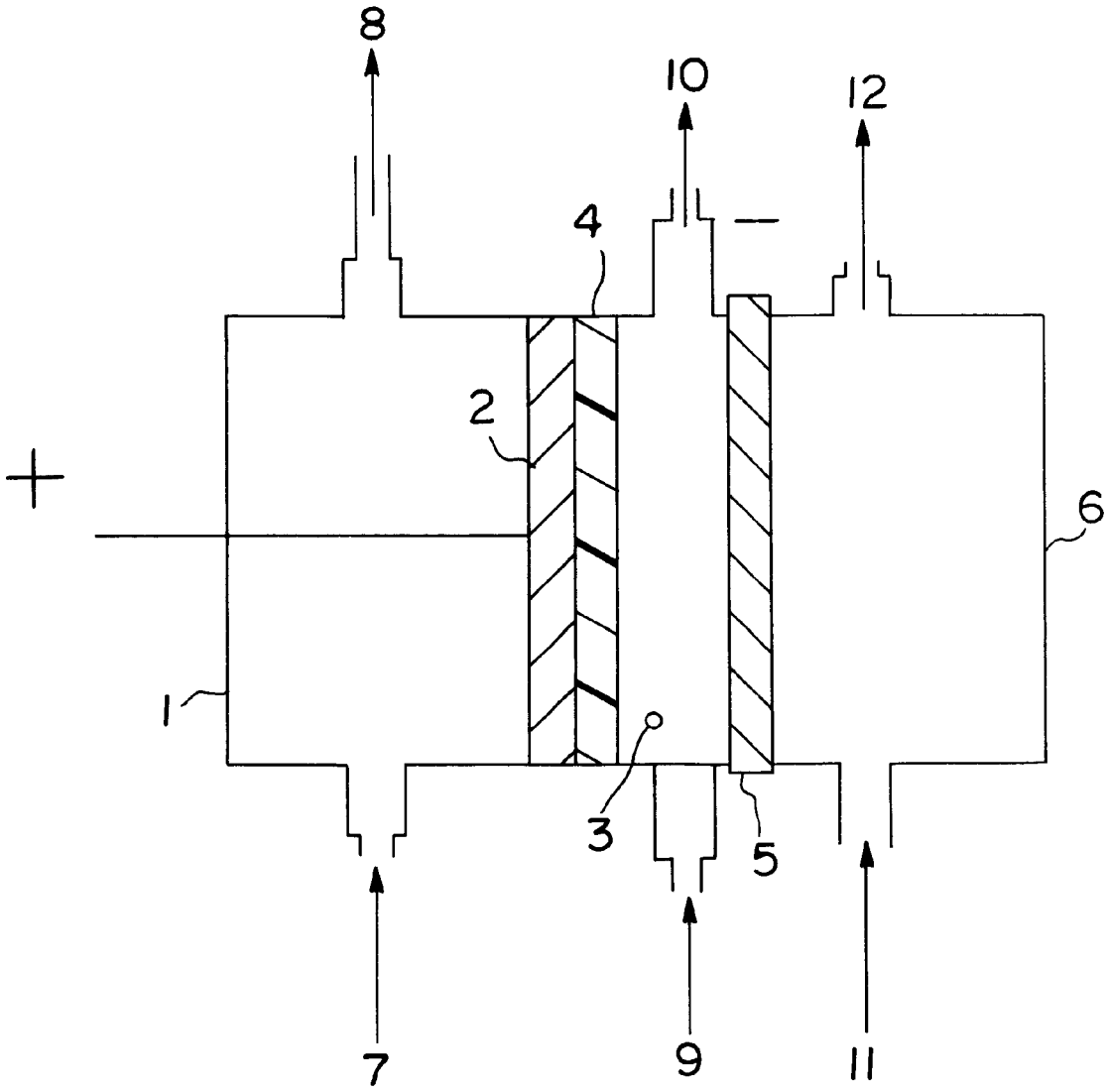

an anode compartment (1), an anode (2), a sodium hydroxide compartment (3), placed between a cation-exchange membrane (4) and the cathode (5), and a gas compartment (6).

The gas containing oxygen may be air, oxygen-enriched air or alternatively oxygen. Oxygen will preferably be used.

The method of the present invention has the advantage that an electrolysis cell having a membrane and an oxygen-reducing cathode can be shut down under conditions such that, on restarting, the cathode has kept its performance intact.

It is furthermore found that the sodium hydroxide yield (faradaic efficiency) is maintained.

The following examples illustrate the invention.

Use is made of a cell for electrolysing an aqueous solution of sodium chloride, as represented in FIG. 1.

This cell consists of:

an anode compartment consisting of a cell body (1). The sodium chloride solution (brine) is introduced through (7) and circulates by lift gas inside the cell. The chlorine which is produced escapes at (8), an anode (2) made of open-worked titanium coated with $RuO_2/TiO_2$, a 3 mm thick sodium hydroxide compartment (3) placed between the cation-exchange membrance (4) and the cathode (5). It has one inlet (9) and two outlets (10) for circulation of the sodium hydroxide. It is also provided with a capillary for positioning a reference electrode, and a thimble for measuring the temperature; these accessories are not represented in FIG. 1.

The membrane (4) is Nafion® N966. The cathode (5) is made of a nickel grid covered on either side with platinized carbon. One of the faces is coated with a fluorocarbon micropore layer in order to make it more hydrophobic.

The platinum represents 10% by weight of the carbon/platinum combination and its average mass per unit surface area is 0.56 mg/cm$^2$.

The electrode is about 0.4 mm thick.

The electric current is delivered through a nickel ring placed at the periphery of the front face of the cathode. Since the rear face is coated with PTFE, it does not conduct. A nickel brace is placed behind the electrode in order to limit its deformation.

In the absence of hydrogen generation at the cathode, the sodium hydroxide is circulated by using a pump. The sodium hydroxide is heated in the recirculation tank. The water is added at the outlet of the sodium hydroxide compartment.

a gas compartment (6).

The oxygen, or gas containing oxygen, which has been decarbonated beforehand by bubbling through the sodium hydroxide, then hydrated by bubbling through water at 80° C. before delivery to the gas compartment, is introduced at (11) and exits at (12). Its pressure is fixed using a water column placed at the outlet of the gas circuit. The gas compartment is equipped with heating cartridges so as to keep the oxygen at temperature (there are not shown in FIG. 1).

The various compartments are made leaktight using PTFE seals.

The reference electrodes which are used are saturated calomel electrodes (SCE) whose potential is +0.245 V/SHE at 25° C.

Operating conditions of the electrolysis cell for all the tests:

NaCl concentration by weight in the anolyte=220 g/l, sodium hydroxide concentration by weight=32–33%, pure oxygen is humidified by bubbling 15 through water at 80° C., its flow rate is 5 l/h, anode temperatures=cathode temperature=80° C., current density i=3 kA/m$^2$.

Where a current density is applied to the electrodes, chlorine resulting from the electrolysis of the aqueous NaCl solution is released in the anode compartment and is discharged via (8); the hydroxyl ions formed by the reduction of oxygen form sodium hydroxide with the alkali cations flowing through the membrane.

Tests not in Accordance with the Invention

The cell described above operated for 2 days, after which the said cell was turned off without disassembly, and the shutdown conditions used were applied to the electrolysis cells with a membrane and a cathode evolving hydrogen.

Shutdown conditions (I):

electrical supply turned off (electrodes de-energized), sodium hydroxide (3) and brine (1) compartments emptied then filled with 20% strength sodium hydroxide, in the case of the cathode compartment, and 220 g/l of brine in the case of the anode compartment, the gas compartment is unchanged, that is to say the oxygen is maintained.

Differences in cathode potential were observed before and after various outage phases in comparison with the initial potential (new electrode) or the potential obtained after stopping the electrolysis (the outage phase being managed as described above).

The results are reported in Table 1.

In this table:

Ei represents the initial cathode potential of the new electrode,

Ea represents the cathode potential before 25 outage,

Ef represents the cathode potential after outage.

TABLE 1

| Outage | Outage period (days) | Ei–Ef (mV) | Ea–Ef (mV) |
|---|---|---|---|
| 1 | 1 | 30 | 30 |
| 2 | 10 | 120 | 90 |
| 3 | 4 | 260 | 140 |

At each restart, the cathode potential increases in absolute value from 30 to 140 mV for a current density of 3 kA/m$^2$. This rise increases as a function of the number of times the cathode is turned off.

This change in the cathode potential affects the cell voltage and leads to an increase in the energy consumption of the process from 20 to 100 kWh/t (NaOH) per outage phase.

Tests in Accordance with the Invention

The electrolysis cell described above was turned off several times without disassembly, and the following shutdown conditions (II) were applied:

electrolysis stopped (electrodes de-energized), the three compartments were emptied, the compartments were filled:

anode compartment, with a 220 g/l clean NaCl solution sodium hydroxide compartment, with sodium hydroxide having a concentration equal to 1 mol-g/l, and gas compartment, with demineralized water having a pH equal to 7, the cathode was rinsed with demineralized water from the gas compartment, and the demineralized water was allowed to flow out of the cell until the pH was neutral.

The temperature of the fluids which were injected is equal to 30° C.

Table 2 represents the differences in the cathode potential before and after various outage phases in comparison with the initial potential or the potential obtained after the electrolysis was turned off, the outage phase being managed according to the shutdown conditions (II).

In this table, Ei, Ea and Ef have the same meanings as those given above.

TABLE 2

| Outage | Outage period (days) | Ei–Ef (mV) | Ea–Ef (mV) |
|---|---|---|---|
| 4 | 1 | 10 | 10 |
| 5 | 1 | 30 | 20 |
| 6 | 4 | 60 | 30 |
| 7 | 1 | 74 | 14 |
| 8 | 2 | 74 | 0 |

The change in the cathode potential, and therefore the cell voltage, is perfectly controlled. The properties of the membrane are not modified by this shutdown procedure: the sodium hydroxide yield obtained after restarting (or faradaic efficiency) is unchanged with respect to its value before outage, that is to say equal to 97%.

This improvement is independent of the technology of the cell proper and of the nature of the catalyst (platinum, silver, etc.).

In the following tests, the various shutdown procedures were compared. Test 12 was carried out with the shutdown conditions (II), except that the gas compartment is filled with a demineralized aqueous solution of hydrochloric acid having a molar concentration equal to 1 mol-g/l, shutdown conditions (III), instead of demineralized water.

The cathode is rinsed with the hydrochloric acid solution from the gas compartment until the pH is acidic (until pH 0.1 is obtained).

Table 3 reports the results which are obtained.

In this table, Ei, Ea and Ef have the same meanings as those given above. NC means: not in accordance with the invention.

TABLE 3

| Outage | Shutdown conditions | Outage period (days) | Ei–Ef (mV) | Ea–Ef (mV) |
|---|---|---|---|---|
| 9 | II | 5 | 10 | 10 |
| 10 NC | I | 2 | 160 | 150 |
| 11 | II | 1 | 160 | 0 |
| 12 | III | 4 | 80 | −80 |

Shutting down the cell under conditions using 1M HCl (outage 12) after an outage phase according to shutdown conditions (I) (outage 10) makes it possible to regenerate the cathode and therefore to improve the performance of the cell. The energy saving is then 56 kWh/t (NaOH). The properties of the membrane are not modified by this shutdown procedure. The sodium hydroxide yield obtained after restarting (or faradaic efficiency) is unchanged from its value before outage.

Comparing these tests makes it possible to state the loss in performance of the cathode (cathode potential) is not due to a loss of platinum, because an acidic treatment did not make it possible to recover some of the said performance for the cathode.

The polarization curves of an electrode make it possible to display its behavior as a function of the working current density.

They also make it possible to express this behavior by a simple mathematical equation (straight line of the form E—a.i+b), which is informative of the activity of the material which is used (b) and of the overall resistance of the electrode (a).

Plotting these curves as a function of time therefore makes it possible to demonstrate the origin of the loss in performance of a cathode (increase in absolute value of the potential for a fixed current density): when a increases, it is the resistance of the cathode which is at fault.

Figure 2:
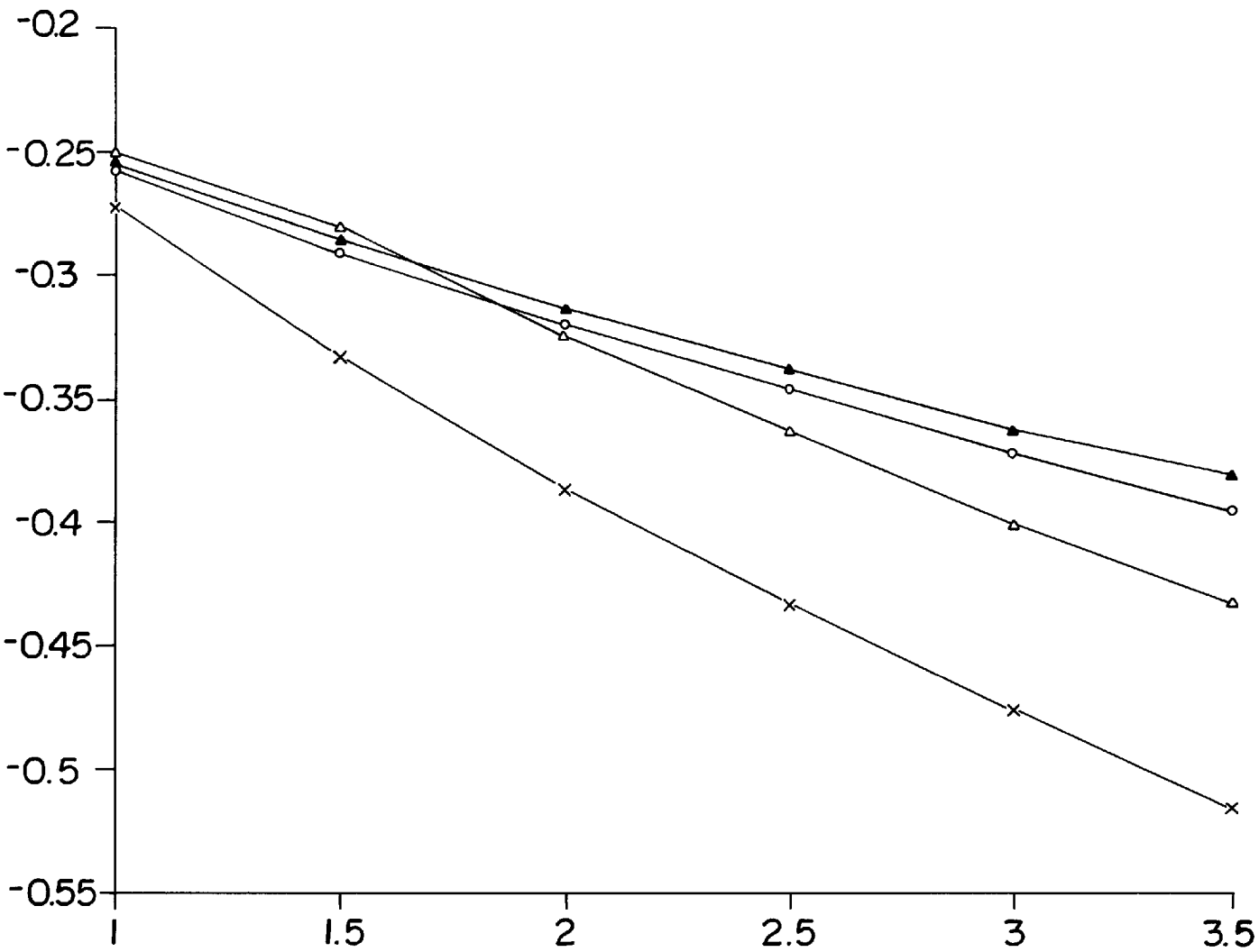

FIG. 2 represents the polarization curves obtained for a cathode as used in the above tests, according to the shutdown protocols used during the outage phases. The cathode potential is measured with respect to a reference electrode (SCE), and the working temperature is 80° C.

According to FIG. 2:

the cathode potential is plotted in V/SCE on the ordinate, the current density in kA/m$^2$ is plotted on the abscissa.

▲ corresponds to a new cell,

◇ corresponds to outage 9 (Table 3)

X corresponds to outage 10 (Table 3)

Δ corresponds to outage 12 (Table 3).

The slope of the polarization curve increases by 6% after outage phase No. 9 (Table 3) (lasting 5 days), by 66% after outage 10 (Table 3) (lasting 2 days, value calculated between after outages 10 and 9), then decreases by 20% after a 4-day outage phase (outage 12 (Table 3)) (value calculated between the curves after outages 12 and 10).

These curves make it possible, in particular, to advance the opinion that the loss in performance for the cathode is due to an increase in its overall resistance.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosure of all applications, patents and publications, cited above, and of French priority application 97/15607, filed Dec. 10, 1997, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method for shutting down an electrolysis cell used for the production of chlorine and sodium hydroxide with a membrane and an oxygen-reducing cathode, characterized in that, after the electrical power and oxygen supplies to the said cell have been disconnected, the gas compartment is emptied and filled with demineralized water optionally acidified, having a pH equal to or less than 7, and treating the cathode by rinsing with demineralized water from the gas compartment, measuring the pH and continuing the rinsing until a pH equal to or less than 7 is obtained, and said gas compartment is kept filled with the said demineralized water throughout the shutdown period.

2. A method according to claim 1, characterized in that the demineralized water has a pH equal to 7.

3. A method according to claim 1, characterized in that the demineralized water has a pH of between 0 and 7.

4. A method according to claim 1, wherein the demineralized water is acidified and has a pH of 0.1 to 1.

5. A method according to claim 1, wherein said treating of said cathode consists essentially of said rinsing.

6. A method according to claim 1, wherein said rinsing is conducted until a pH of 7 is reached.

7. A method for shutting down an electrolysis cell used for the production of chlorine and sodium hydroxide with a membrane and an oxygen-reducing cathode, characterized in that, after the electrical power and oxygen supplies to the said cell have been disconnected, the gas compartment is emptied and filled with demineralized water optionally acidified, having a pH equal to or less than 7, the cathode is rinsed with demineralized water from the gas compartment until a pH equal to or less than 7 is obtained, and the said gas compartment is kept filled with the said demineralized water throughout the shutdown period; the anode compartment is also emptied then filled with a clean anolyte and the sodium hydroxide compartment is emptied then filled with a sodium hydroxide solution with a molar concentration of between 0.5 and 5 mol-g/l.

8. A method according to claim 7, characterized in that the demineralized water has a pH equal to 7.

9. A method according to claim 7, characterized in that the demineralized water has a pH of between 0 and 7.

10. A method according to claim 7, wherein the demineralized water is acidified and has a pH of 0.1 to 1.

11. A method according to claim 7, wherein said electrolysis cell at the start of the production of chlorine and sodium hydroxide contains a starting anolyte solution and said clean anolyte has the same type and concentration as said starting anolyte solution.

* * * * *